US005235712A

United States Patent [19]

Smith

[11] Patent Number: 5,235,712

[45] Date of Patent: * Aug. 17, 1993

[54] APPARATUS FOR BATHING A PATIENT CONFINED TO A BED

[75] Inventor: Gene A. Smith, Shallotte, N.C.

[73] Assignee: Ary Lift, Inc., Shallotte, N.C.

[ * ] Notice: The portion of the term of this patent subsequent to Dec. 3, 2008 has been disclaimed.

[21] Appl. No.: 801,642

[22] Filed: Dec. 2, 1991

Related U.S. Application Data

[63] Continuation-in-part of Ser. No. 718,971, Jun. 21, 1991, Pat. No. 5,068,931.

[51] Int. Cl.[5] ..... A61G 7/10; A61G 9/02; A47K 3/06

[52] U.S. Cl. ..... 5/84.1; 5/85.1; 5/88.1; 5/612; 5/928; 4/585

[58] Field of Search ..... 5/81.1, 88.1, 85.1, 5/84.1, 83.1, 86.1, 928, 612, 606; 4/564, 585

[56] References Cited

U.S. PATENT DOCUMENTS

| | | | |
|---|---|---|---|
| 528,475 | 10/1894 | Goulding | 5/86.1 |
| 545,741 | 9/1895 | Shutters | 5/88.1 |
| 680,814 | 8/1901 | Smith . | |
| 775,520 | 11/1904 | Crigler | 5/83.1 |
| 904,587 | 11/1908 | Wible . | |
| 1,227,301 | 5/1917 | Ogden | 5/85.1 |
| 1,263,611 | 4/1918 | Scroggin | 5/88.1 |
| 1,301,284 | 4/1919 | Ledan | 5/84.1 |
| 1,451,437 | 4/1923 | Bernier | 4/587 |
| 1,588,573 | 6/1926 | Edmiston | 5/84.1 |
| 1,968,477 | 7/1934 | Cole | 5/85.1 |
| 2,035,116 | 3/1936 | Elmick | 5/85.1 |
| 2,100,663 | 11/1937 | Maddox | 5/85.1 |
| 2,283,511 | 5/1942 | Sellers et al. | 5/88.1 |
| 2,603,851 | 7/1952 | Hawkins | 5/85.1 |
| 2,629,108 | 2/1953 | Wickey | 5/84.1 |
| 3,334,360 | 8/1967 | Hoxeng et al. | 4/585 |
| 3,373,451 | 3/1968 | Schmidt | 4/585 |
| 3,383,717 | 5/1968 | Underwood | 5/88.1 |
| 3,701,170 | 10/1972 | Bond | 5/81.1 |

FOREIGN PATENT DOCUMENTS

| | | | |
|---|---|---|---|
| 4795 | 2/1914 | United Kingdom | 5/84 |
| 850516 | 10/1960 | United Kingdom | 5/88.1 |

*Primary Examiner*—Alexander Grosz
*Attorney, Agent, or Firm*—W. Thad Adams, III

[57] ABSTRACT

An invalid patient lifting and turning apparatus which includes an open framework for being positioned above a bed, an elevator supported by the open framework and a patient support straps for being positioned on a mattress of the bed underneath the patient and remaining underneath the patient at all times. The straps are removable and replaceable for extending laterally from side-to-side along the length of the patient for supporting the patient's head, trunk and legs. Connecting straps are provided for connecting the patient support straps and the elevator thereby permitting the patient support straps to lift the patient above the mattress surface for cleaning and bed-linen changing. A reservoir is provided for being positioned on the mattress under the patient while the patient is suspended above the mattress so that the patient can be bathed or showered in the bed.

13 Claims, 9 Drawing Sheets

FIG. 17

APPARATUS FOR BATHING A PATIENT CONFINED TO A BED

TECHNICAL FIELD AND BACKGROUND OF THE INVENTION

This application is a continuation-in-part application of Ser. No. 718,971 filed on Jun. 21, 1991 now U.S. Pat. No. 5,068,931.

This invention relates to an apparatus for bathing a patient confined to a bed. The patient is bathed by lifting the patient above the surface of the bed. The ability to easily lift and turn a patient permits the patient to be easily bathed, dressed and undressed, exercised and otherwise cared for in ways which are difficult or impossible when the patient cannot be removed from the bed and therefore must be moved around on the surface of the bed. The ability to lift and suspend the patient above the surface of the bed permits easy and frequent changes of bed linens. These features substantially reduce staff labor and the amount of time required to properly and compassionately attend to a patient's physical and sanitary needs, reduce odors, skin infections and bed sores, and substantially improves the overall level of care which can be provided.

The apparatus according to the invention is equally adaptable for use in hospitals, nursing homes and in the patient's own home. In fact, the ease with which the patient can be cared for using the apparatus and method of the invention permits many patients to be cared for by their family at home, rather than being confined to a nursing home or hospital.

Typical procedures used to care for bedridden patients require that the patient be physically moved about on the surface of the bed. Bathing the patient is a particular problem, since improper or infrequent bathing can promote infection, odor, skin sores and a general debilitation of the patient.

Bathing patients is quite difficult while the patient is lying on the bed. Many areas of the body are difficult to reach and properly clean unless the patient is turned or rolled. Constant contact between the patient and the bed almost insures re-soiling of either the patient or the bed linens since both cannot be cleaned at the same time. The invention of this application permits the patient to be completely bathed without removing the patient from the bed. The invention also permits the patient to be given a shower bath, a more sanitary and refreshing means of cleaning the patient.

The apparatus of the invention were conceived and developed as the result of a husband's desire to care for his invalid wife at home, and the unavailability of any apparatus to assist in caring for the wife's sanitary needs.

The particular embodiments disclosed herein also make provision for giving a patient a quick and yet completely thorough bath by placing a portable container under the suspended patient.

SUMMARY OF THE INVENTION

Therefore, it is an object of the invention to provide an apparatus which permits a bedridden patient to be lifted and suspended above the bed while the bed linens are changed.

It is another object of the invention to provide an apparatus which permits a bedridden patient to be bathed while suspended above the bed.

It is another object of the invention to provide an apparatus which permits a bedridden invalid patient to be turned from side-to-side while on the bed.

It is another object of the invention to provide an apparatus which can be attached to and used with a conventional type of bed.

It is another object of the invention to provide an apparatus which can be rolled from bed-to-bed or to bathing or other stations with the patient suspended thereon.

It is another object of the invention to provide an apparatus which can be rolled from bed-to-bed or to bathing or other stations while empty whereby a single apparatus can service numerous patients.

It is another object of the invention to provide an apparatus which can be integrally formed with a bed.

It is another object of the invention to provide a method of turning a patient from side-to-side while confined to an invalid bed.

It is another object of the invention to provide a method of changing bed linens of invalid bed and cleaning a patient, including giving the patient a bath, such as a shower bath, while the patient is confined to the invalid bed.

It is another object of the invention to provide a method of attending to various parts of the patient by selective removal of the means by which the patient is suspended above the bed.

These and other objects of the present invention are achieved in the preferred embodiments disclosed below by providing an invalid patient lifting and turning apparatus which includes an open framework for being positioned above a bed, elevator means supported by the open framework, and patient support means for being positioned on a mattress of the bed underneath the patient and remaining underneath the patient at all times. The support means comprises a plurality of spaced-apart, removable and replaceable strap means for extending laterally from side-to-side along the length of the patient for supporting the patient's head, trunk and legs. Connecting means are provided for connecting the patient support means and the elevator means thereby permitting the patient support means to lift the patient above the mattress surface for cleaning and bed-linen changing. Patient bathing means are provided for permitting the patient to be bathed while remaining in the bed. The patient is suspended above the mattress of the bed and the reservoir is placed under the patient, for example, by placing the reservoir on the mattress of the bed.

According to one preferred embodiment of the invention, the elevator means includes first and second spaced-apart winding bars extending along the length of the framework, a motor carried by the framework, and drive means operatively interconnecting the motor and the first and second winding bars for rotating the winding bars in opposite winding and unwinding directions.

According to another preferred embodiment of the invention, the connecting means includes first and second pairs of spaced-apart elongate flexible members connected by one end to respective first and second winding bars and first and second spacing bars positioned on opposite sides of the framework and extending along the length of the framework in longitudinal alignment with the winding bars and connected to the other end of respective ones of the pairs of flexible members.

According to yet another preferred embodiment of the invention, the bathing reservoir is plastic and is suspended from the spacing means.

According to one preferred embodiment of the invention, the drive means includes a drive sprocket on the motor and first and second driven sprockets positioned for rotation respectively with the first and second winding bars. An endless chain interconnects the drive sprocket and the first and second driven sprockets for transmitting rotary motion from the motor to the first and second winding bars.

According to another preferred embodiment of the invention, the drive means includes a third winding bar mounted on the framework between the first and second winding bars and extending along the length of the framework in axial alignment with the first and second winding bars, and first and second straps, each connected by one end thereof to the third winding bar and by the opposite end thereof to respective ones of the first and second winding bars. One of the first and second straps extends around the third winding bar in a clockwise direction and the other of the first and second straps extends around the third winding bar in a counterclockwise direction. Rotation of the motor in one direction winds both first and second straps onto the third winding bar and rotation in the other direction unwinds both the first and second straps off of the third winding bar.

According to yet another preferred embodiment of the invention the elongate means comprises a strap.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

DESCRIPTION OF APPARATUS—FIG. 1

Figure 1:
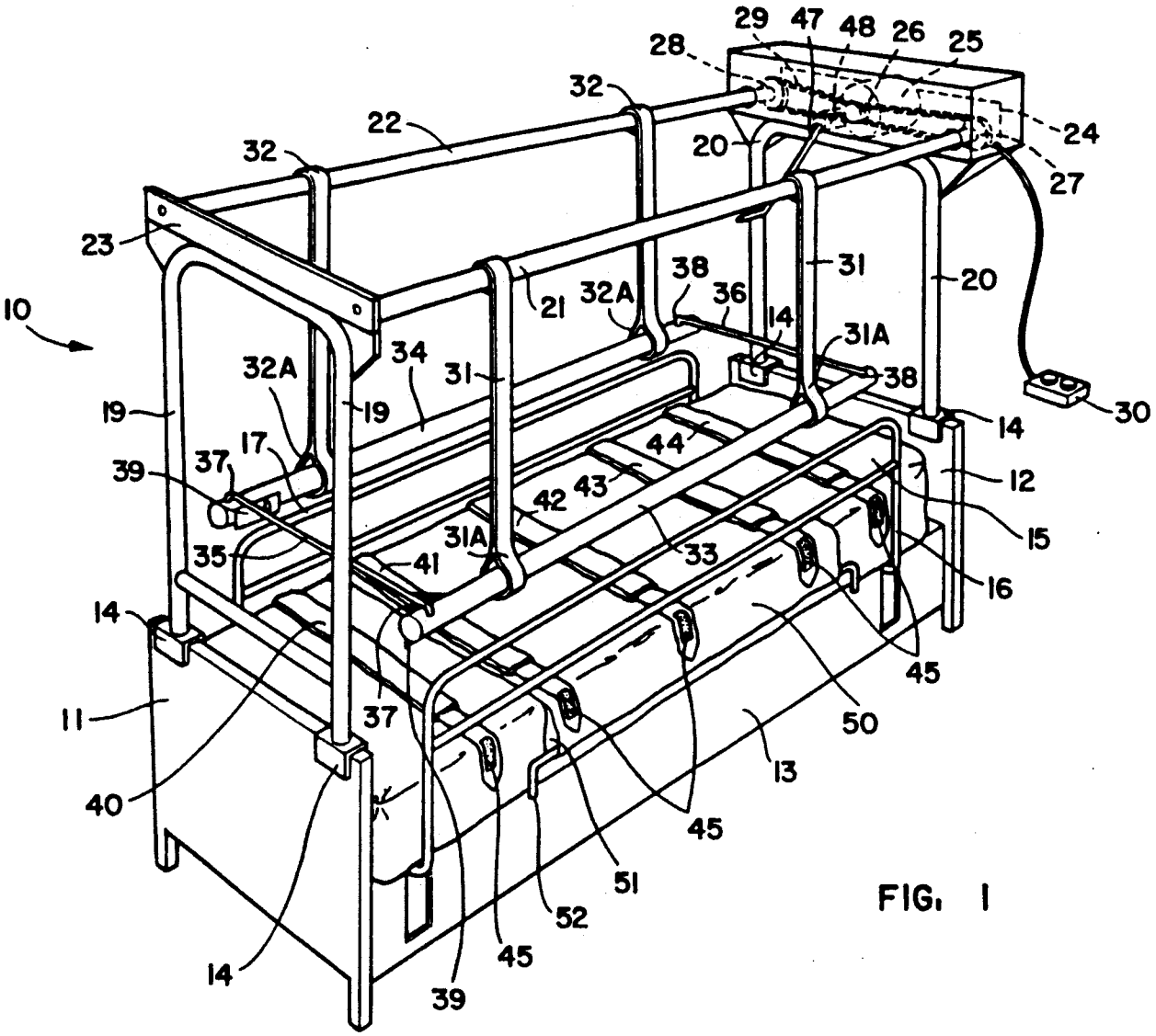
FIG. 1 is a perspective view of an apparatus for lifting and turning an invalid patient positioned on a hospital bed.

Referring now specifically to the drawings, an apparatus for lifting and turning a patient according to the present invention is illustrated in FIG. 1 and shown generally at reference numeral 10. Apparatus 10 is shown mounted on the footboard 11 and headboard 12 of a hospital bed 13 by brackets 14 which are positioned on the top edge of the footboard 11 and headboard 12. Brackets 14 may be attached by bolts, clamps or by other suitable means. Bed 13 includes a mattress 15 and vertically adjustable side rails 16 and 17.

Apparatus 10 is comprised of on open framework which includes upright foot and head standards 19, 20 to which the brackets 14 are secured. Winding bars 21 and 22 are mounted in suitable bearings (not shown) and are carried by winding bar supports 23, 24. Winding bars 21 and 22 are driven by a motor and gear reduction unit 25 mounted on winding bar support 24. Motor and gear reduction unit 25 has a drive sprocket 26 which drives driven sprockets 27 and 28 concentrically mounted on winding bars 21 and 22, respectively by means of a sprocket chain 29. In the preferred embodiment a 1650 rpm, 1/6 hp reversible duty single phase motor is reduced through a 40 to 1 gear reduction unit. The diameter and teeth of the gearing are selected to provide 11 rpm for the winding bars 21 and 22. Of course, many other combinations of motor sizes, powers and drive arrangements are usable with suitable adjustments in gearing. A control box 30 controls operation of the motor 25 and therefore the motion of the winding bars 21 and 22.

Connecting means comprising first and second pairs of straps 31, 32 are wound onto winding bars 21 and 22 and secured by bolts (not shown) or by similar means. Both pairs of straps 31, 32 are wound in a counterclockwise direction since motor 25 rotates gears 27 and 28 in the same direction. The other end of pairs of straps 31 and 32 are formed into loops 31A, 32A. These loops 31A, 32A receive and support respective spacing bars 33 and 34. Normally, spacing bars 33 and 34 are positioned at or just slightly above the upper surface of mattress 15. Spacing bars 33 and 34 are shown in a slightly elevated position in FIG. 1.

Spacing bars 33 and 34 are maintained in the correct alignment and spacing with each other by means of braces 35 and 36. Brace 35 is positioned in holes 37 in the upper side of one foot end of spacing bars 33 and 34, and includes side braces 39 which keep spacing bars 33 and 34 parallel with the winding bars 21 and 22. Brace 36 is positioned in holes 38 in the upper side of the head end of spacing bars 33 and 34.

Patient support means comprise a plurality of thick lamb's wool covered support straps—in FIG. 1 five such straps 40–44 are shown. Either more or fewer straps may be used depending on the size and weight of the patient, the width of the straps and similar factors. Each end of the straps 40–44 have complementary male and female hook and loop fasteners 45 (only the male is shown) by which the support straps 40–44 are securely fastened to spacing bars 33 and 34. As is shown in FIG. 1, the support straps 40–44 are laterally, i.e., side-to-side, positioned in spaced-apart relation along the length of the mattress 15. The spacing as well as the number of support straps 40–44 is determined by the size of the patient and the width of the support straps 40–44. Typically, five support straps will be used for a normal sized adult patient—one each for the head/neck; upper torso, lower torso/buttocks, upper legs and lower legs/feet. The support straps 40–44 are positioned *directly* beneath the patient, not below the bed sheet, draw sheet or other bed coverings. The thick lambswool padding on the support straps 40–44 prevents irritation and, in fact, is more comfortable for the patient than lying flat on the bed 13 without the support straps 40–44. Once all of the support straps 40–44 are fastened to the spacing bars 33 and 34, the patient can be lifted by activating motor and gear reduction unit 25 through use of the control box 30. A height detection finger 47 connected to a limit switch shuts 48 off motor and gear reduction unit 25 when contacted by brace 36 to prevent the patient from being lifted too high. Normally, the patient would never need to be lifted more than about 12–15 inches off of the surface of mattress 15.

Patient turning means are also provided, and comprise a draw sheet 50 centered laterally across bed 13. Draw sheet 50 includes a folded loop 51 in each side of the draw sheet 50 into which and through which is positioned a sheet attachment bar 52.

DESCRIPTION OF APPARATUS—FIG. 8

Figure 8:
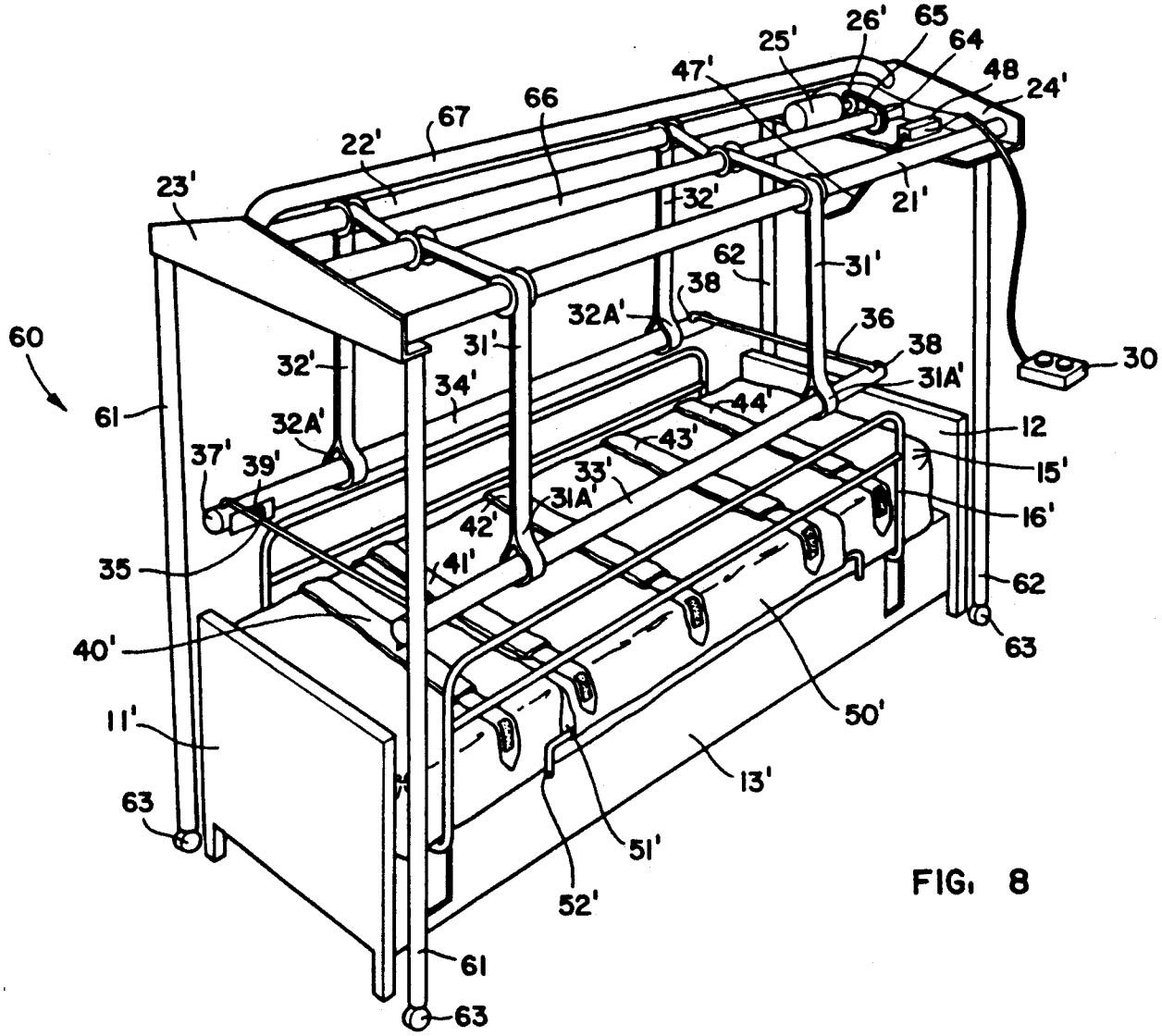
FIG. 8 is a perspective view of an alternative embodiment of an apparatus for lifting and turning an invalid patient which is adapted to be moved from bed-to-bed.

Referring now to FIG. 8, an apparatus for lifting and turning a patient according to another embodiment of the present invention is illustrated in FIG. 8 and shown generally at reference numeral 60. In the text which follows, elements which have counterparts in the description of apparatus 10 are identified with the same reference numerals.

Apparatus 60 is a portable unit which can be moved from bed-to-bed, or which can be used to transport a patient from one bed to another or to other facilities. Apparatus 60 is comprised of an open framework which includes upright foot and head standards 61, 62 which are mounted on caster wheels 63. Standards 61 and 62 are spaced apart sufficiently wide to permit apparatus 60 to be positioned over a bed 13' by rolling it over the bed from one side. Alternatively, an apparatus could be sized to permit it to be rolled over the bed 13' from the front or rear. Bed 13' includes a footboard 11', a headboard 12' mattress 15' and vertically adjustable side rails 16' and 17'.

Winding bars 21', 22' which are stationary, and center winding bar 66, which is mounted in suitable bearings (not shown) and are carried by winding bar supports 23' and 24'. Center winding bar 66 is centrally mounted and is driven by motor and gear reduction unit 25' and in turn drives winding bars 21' and 22'. Motor and gear reduction unit 25' has a drive sprocket 26' which drives a driven sprocket 64 by means of a sprocket chain 65. Sprocket 64 is mounted on the end of the centrally mounted winding bar 66 for rotation therewith.

A winding bar support brace 67 is secured to winding bar supports 23', 24' by opposite ends and extends the length of the apparatus 60 in order to provide greater stability.

In the preferred embodiment a 1650 rpm, 1/6 hp reversible duty single phase motor is reduced through a 40 to 1 gear reduction unit. The diameter and teeth of the gearing are selected to provide 11 rpm for the winding bar 66. Of course, many other combinations of motor sizes, powers and drive arrangements are usable with suitable adjustments in gearing.

A control box 30' controls operation of the motor and gear reduction unit 25' and therefore the motion of the winding bars 21', 22' and 66.

Connecting means comprising first and second pairs of straps 31', 32' pass over the top of stationary winding bars 21' and 22', through nylon rollers, and are connected by one end to the center winding bar 66 by bolts or some equivalent means. Straps 31', 32' are each wound in a counter-clockwise direction. As is shown in FIG. 8, the straps 31' wind off of the top of center winding bar 66, while straps 32' wind off of the bottom of the center winding bar 66. As a result, operation of motor and gear reduction unit 25' winds the straps 31' and 32' in the same direction notwithstanding that the are attached to the single center winding bar 66. The other end of pairs of straps 31' and 32' are formed into loops 31A', 32A'. These loops 31A', 32A' receive and support respective spacing bars 33' and 34'. Normally, spacing bars 33' and 34' are positioned at or just slightly above the upper surface of mattress 15' Spacing bars 33' and 34' are shown in a slightly elevated position in FIG. 1.

Spacing bars 33' and 34' are maintained in the correct alignment and spacing with each other by means of braces 35' and 36'. Brace 35' is positioned in holes 37' in the upper side of one foot end of spacing bars 33' and 34', and includes side braces 39' which keep spacing bars 33' and 34' parallel with the winding bars 21', 22' and 66. Brace 36' is positioned in holes 38' in the upper side of the head end of spacing bars 33' and 34'.

Patient support means comprise a plurality of thick lambswool covered support straps—in FIG. 8 five such straps 40'–44' are shown. Either more or fewer straps may be used depending on the size and weight of the patient, the width of the straps and similar factors. Each end of the straps 40'–44' have complementary male and female hook and loop fasteners 45' (only the male is shown) by which the support straps 40'–44' are securely fastened to spacing bars 33' and 34'.

As is shown in FIG. 8, the support straps 40'–44' are laterally, i.e., side-to-side, positioned in spaced-apart relation along the length of the mattress 15'. The spacing as well as the number of support straps 40'–44' is determined by the size of the patient and the width of the support straps 40'–44'. Typically, five support straps will be used for a normal sized adult patient-one each for the head/neck; upper torso, lower torso/buttocks, upper legs and lower legs/feet. The support straps 40'–44' are positioned directly beneath the patient, not below the bed sheet, draw sheet or other bed coverings. The thick lambswool padding on the support straps 40'–44' prevents irritation and, in fact, is more comfortable for the patient than lying flat on the bed 13' without the support straps 40'–44.' Once all of the support straps 40–44' are fastened to the spacing bars 33' and 34', the patient can be lifted by activating motor and gear reduction unit 25' through use of the control box 30'. A height detection finger 47' connected to a limit switch shuts off motor and gear reduction unit 25' when contacted by brace 36' to prevent the patient from being lifted too high. Normally, the patient would never need to be lifted more than about 12–15 inches off of the surface of mattress 15.'

Patient turning means are also provided, and comprise a draw sheet 50' centered laterally across bed 13'. Draw sheet 50' includes a folded loop 51' in each side of the draw sheet 50' into which and through which is positioned a sheet attachment bar 52'.

DESCRIPTION OF PATIENT LIFTING METHOD FIGS. 2-4 AND 9-11

Figure 11:
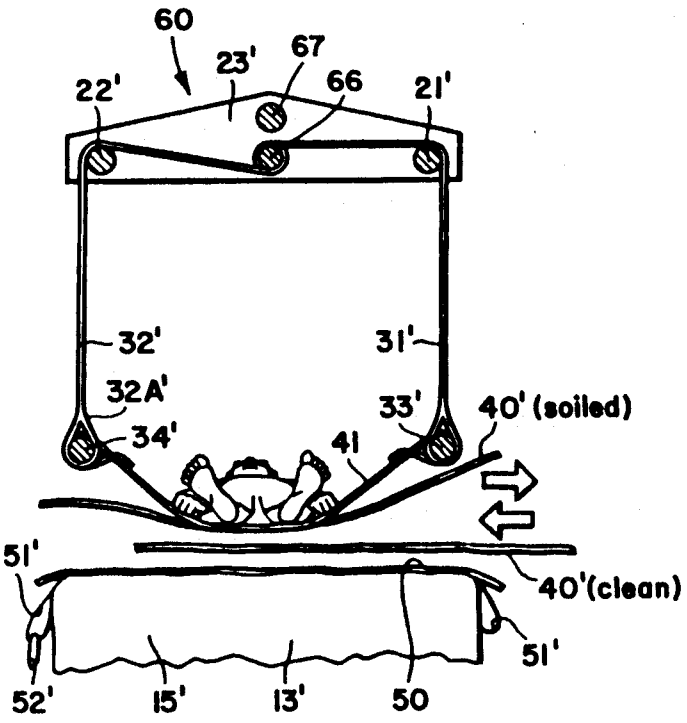
FIGS. 9, 10, 11 are sequential views showing how bed linens are changed by suspending the patient above the bed.
Figure 10:
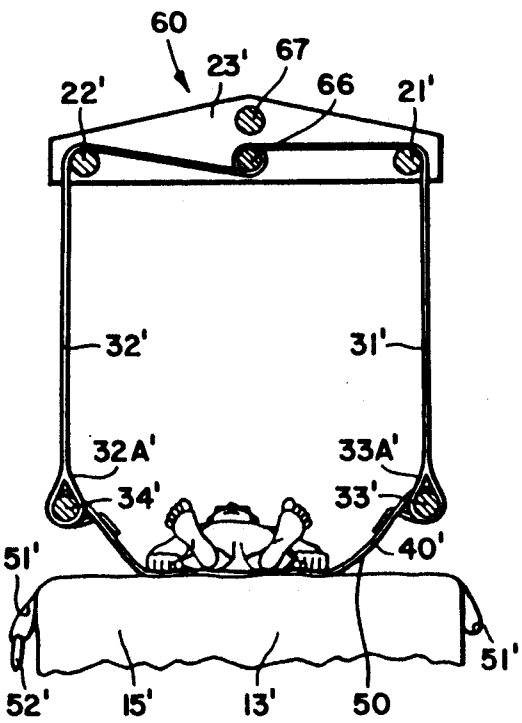
Figure 9:
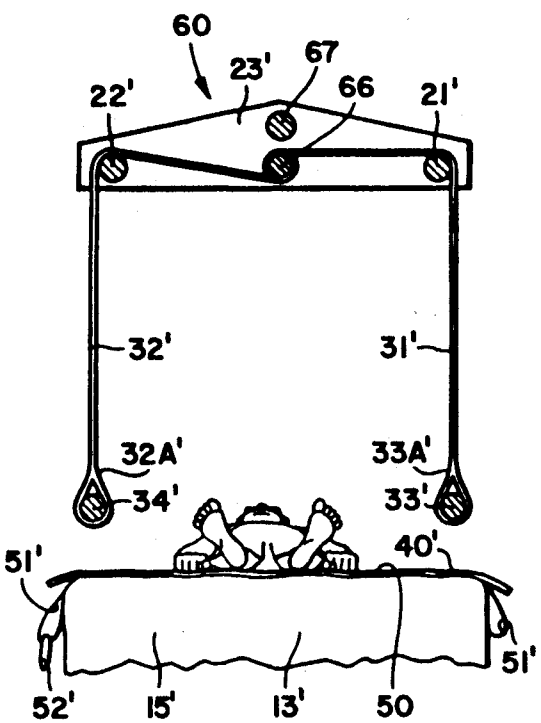

Use of the apparatus 60 permits a patient to be easily and safely lifted. Since the method is the same with either apparatus 10 or 60, it will be described with reference to Apparatus 10, it being understood the method shown in FIGS. 9-11 is also described.

Figures 2, 3, 4:
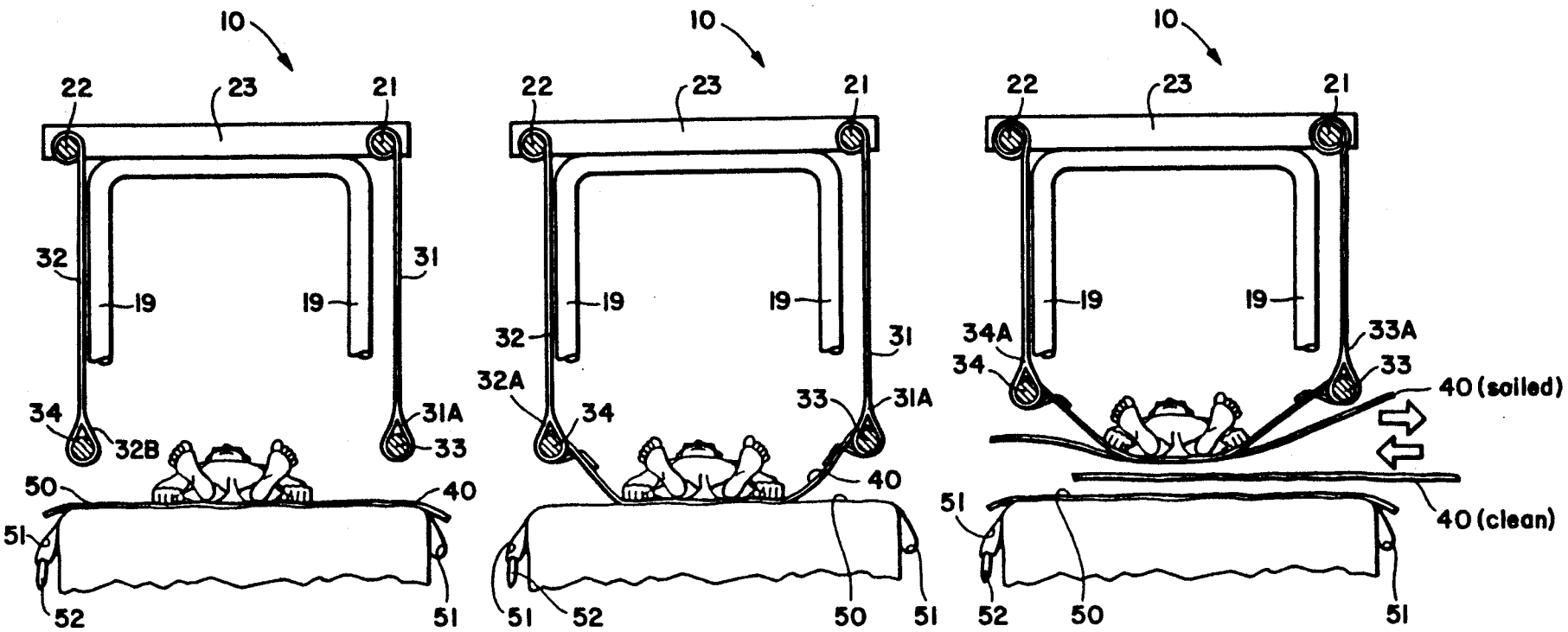
FIGS. 2, 3 and 4 are sequential views showing how bed linens are changed by suspending the patient above the bed.

As is shown in FIGS. 1 and 2, support straps 40-44 are positioned along the length of the bed 1 from side-to-side. They are attached in the manner shown in FIG. 3. With the patient lying on top of the support straps 40-44, the patient is lifted as is shown in FIG. 4. The braces 35 and 36 (not shown for clarity in FIG. 4 but shown in FIG. 1) keep spacing bars 33 and 34 in the proper spacing as is shown in FIGS. 3 and 4.

In this position, the draw sheet 50 and the other bed linens ca easily removed without further moving the patient. The bed 13 is furnished with clean bed linens in a conventional manner—not in the manner used to make invalid beds. The patient can also be cleaned, undressed and dressed while in this position much more quickly and easily than when lying on the bed 13.

Very often the support straps 40-44 will themselves be soiled due to incontinence of the patient. The support straps 40-44 can be easily replaced with cleans ones by merely providing a second set of support straps 40-44. One of the straps of the second set is first attached to the spacing bars 33 and 34 directly adjacent to the one to be replaced. Then the soiled strap, for example strap 40 in FIG. 4, is detached from the spacing bars 33 and 34 and removed. This process is repeated until as many of the straps as desired have been removed and replaced. Then the soiled straps can be laundered, and used to replace the other set of straps when they become soiled.

The support straps 40-44 may be used in other ways as well. Gently removing the strap supporting the patient's head and next while the patient is suspended above the bed permits the patient's hair to be cut and/or washed and dried without wetting or dirtying the bed sheets. With the patient's head above the bed, a plastic protective sheet, basin or other protection can easily be placed under the patient's head.

Removing the strap supporting the patient's lower legs and feet permits the knee to flex and the foot to hang down. In this position the patient's legs can be exercised or massaged. The feet can be washed, the nails cut or other patient care carried out very conveniently and at a comfortable height for the patient care provider.

DESCRIPTION OF PATIENT TURNING METHOD FIGS. 5-7 AND 12-14

Figure 5:
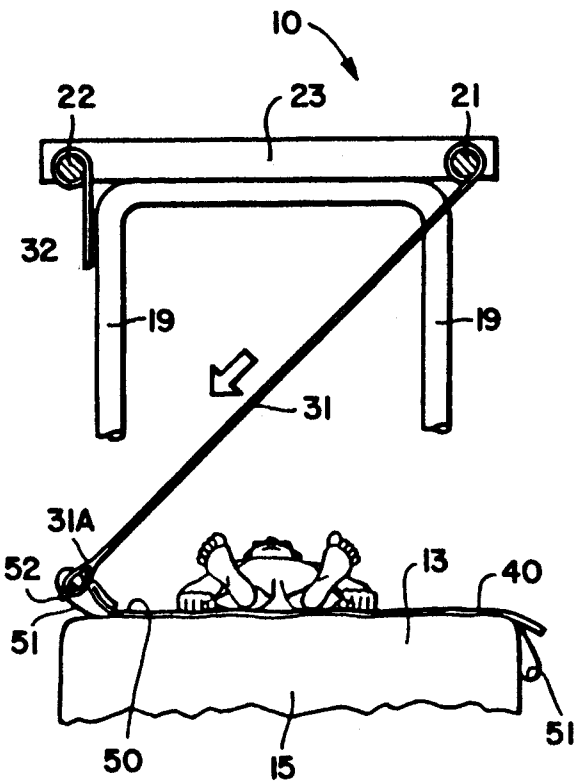
Figure 14:
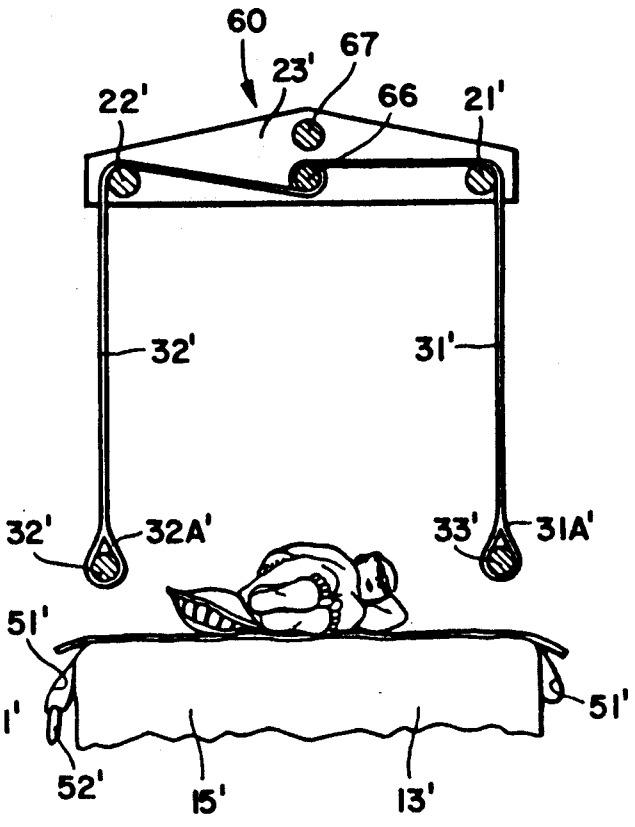
FIGS. 12, 13 and 14 are sequential views showing how an invalid patient is turned.
Figure 13:
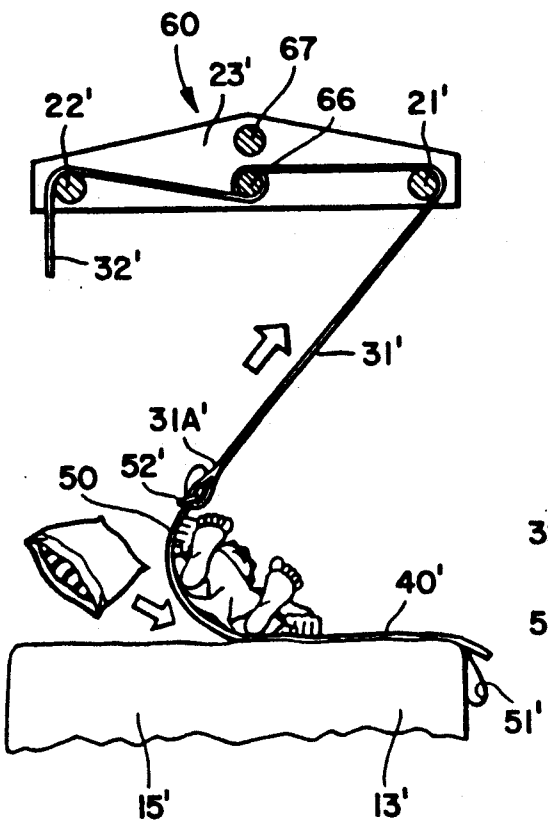
Figure 12:
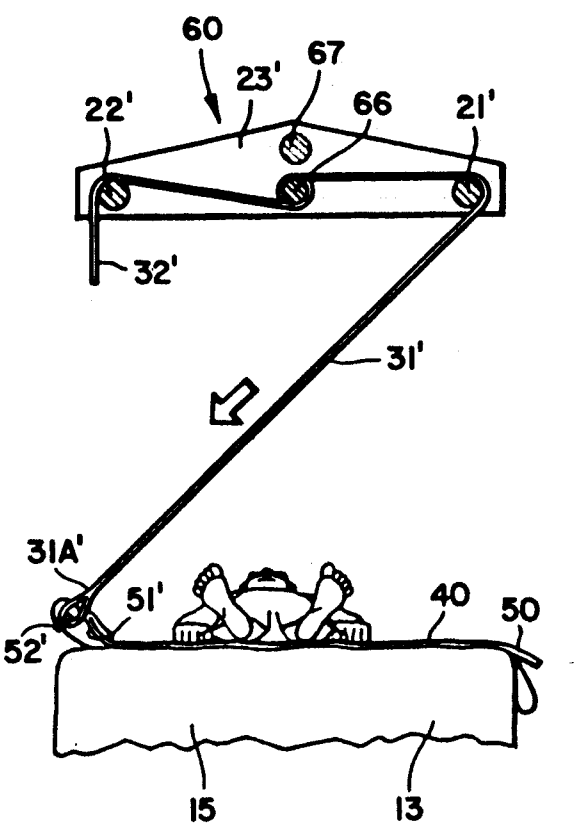

A method of turning a patient is illustrated in FIGS. 5-7 and 12-14. Since the method is the same with either apparatus 10 or 60, it will be described with reference to Apparatus 10, it being understood the method shown in FIGS. 12-14 is also described. To begin the process, spacing bar 33 is removed from strap 31 and put aside. As is shown in FIG. 5, the two straps 31 are extended laterally across the bed 13 to the other side by activating the motor 25 to provide sufficient length for the straps 31 to extend on the diagonal. The sheet attachment bar 52 is positioned in loop 51 of draw sheet 50 so that it extends out both ends. One of the straps 31 is connected to one end of the sheet attachment bar 52 and the other of the straps 31 is attached to the other end of sheet attachment bar 52. This is done by passing the opposing ends of the sheet attachment bar 52 through the loops 31A on the ends of the two straps 31. The support straps 40-44 remain in place under the patient.

Figure 7:
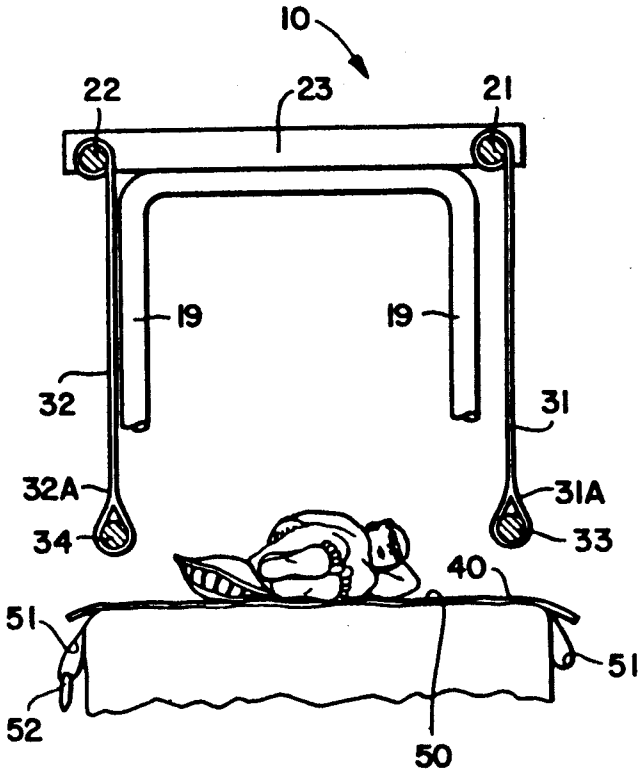
FIGS. 5, 6 and 7 are sequential views showing how an invalid patient is turned.
Figure 6:
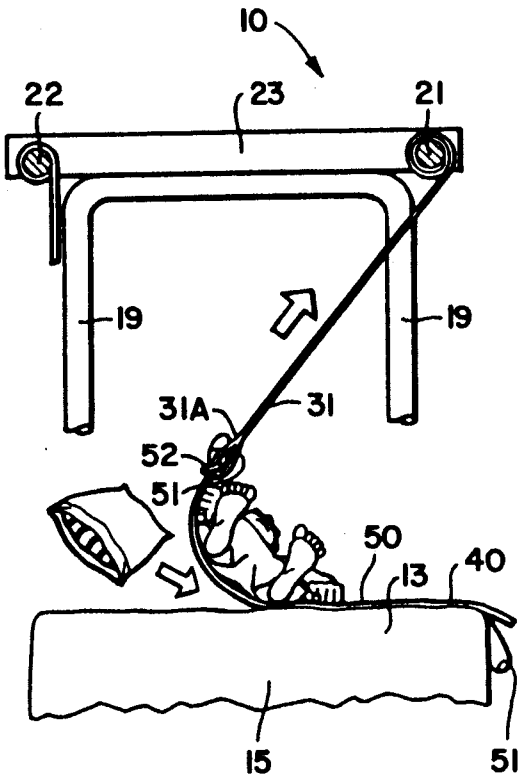

With the apparatus 10 configured as described above, motor 25 is activated and the straps 31 are wound onto the winding bar 21. As is shown in FIG. 6, draw sheet 50 is pulled against the patient from the side of the bed 13 opposite the winding bar 21. As the patient is rolled, a pillow is chocked under the patient to maintain the patient in the turned position. With the patient properly turned and repositioned, straps 31 are removed from the sheet attachment bar and repositioned to support the spacing bar 33, as is shown in FIG. 7.

The patient can be turned in the opposite direction by removing spacing bar 34 from the straps 32, extending the straps 32 across the bed in the manner described above, but across the bed in the opposite direction. The sheet attachment bar 52 is placed in the loop 51 of the draw sheet 50 on the other side of the bed and the process described above is completed.

The structure of apparatus 10 and apparatus 60, including the standards, winding bars, spacing bars and winding bar supports are fabricated from stainless steel bar or tubing as required. The straps 31, 32 and 40-44 are fabricated from heavy-duty webbing of the type used for cargo slings and the like.

DESCRIPTION OF APPARATUS FIGS. 15 AND 16

Figure 15:
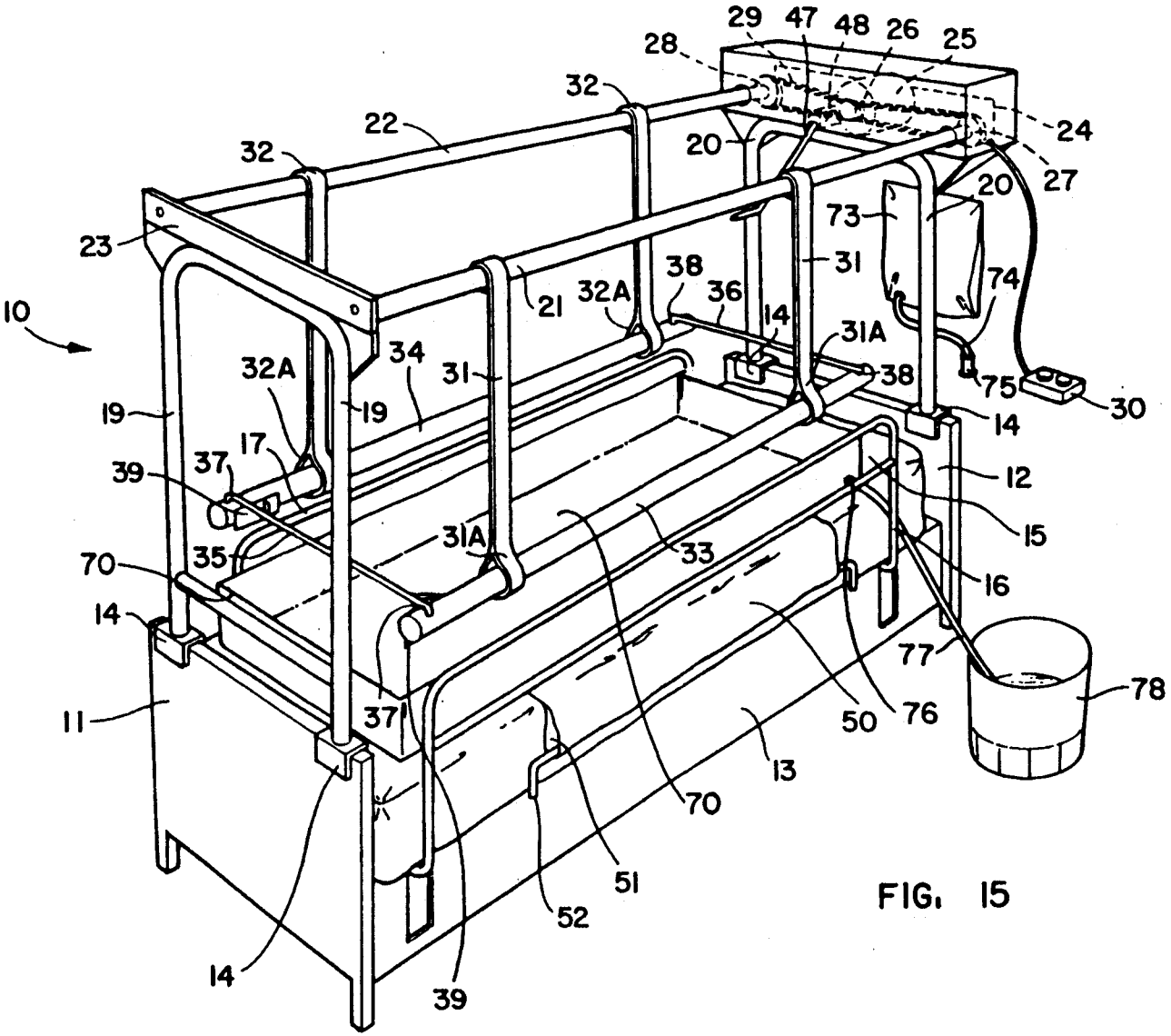
FIG. 15 is a perspective view of an apparatus for lifting and turning an invalid patient positioned on a hospital bed, which bed includes a portable reservoir for catching bathing water.
Figure 16:
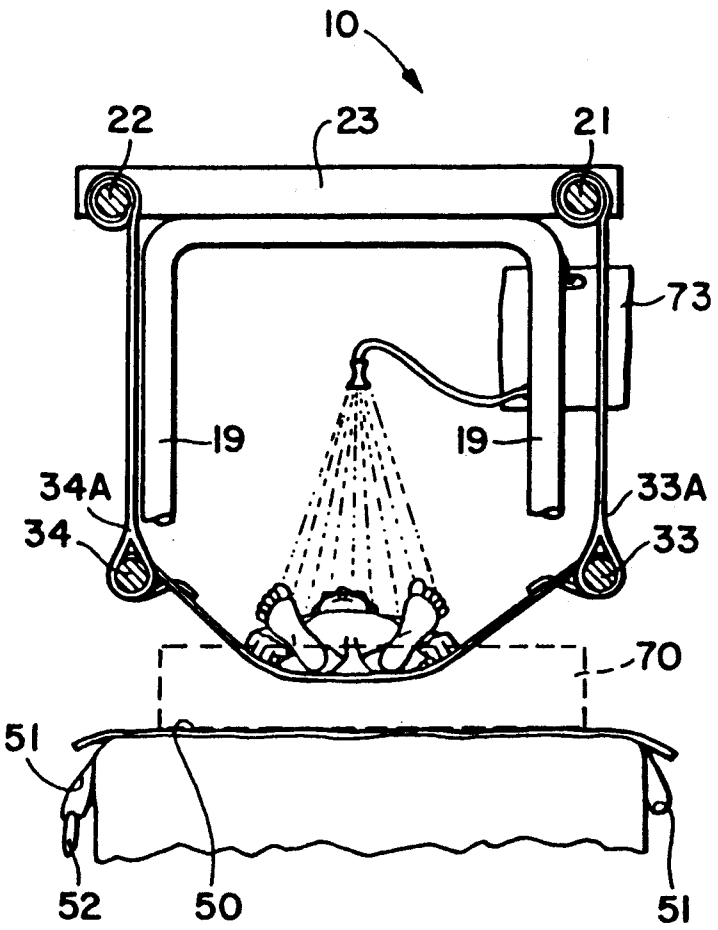
FIG. 16 is a end view showing how the shower is administered to the patient.

Referring now to FIGS. 15 and 16, a further embodiment is illustrated which permits the patient to be bathed while suspended on the straps 31, 32. In the text which follows, elements which have counterparts in the description of apparatus 10 are identified with the same reference numerals.

In FIG. 15, a shallow plastic reservoir 70 is designed to be placed under the patient by placing the reservoir 70 on the mattress 50 after the patient has been raised above the surface of the mattress supported by the straps 40-44. A plastic water bag 73 is filled with warm water from a water supply and suspended by a hook from a suitable support member of the bed. Water is drained from the bag 73 by gravity through a tube 74 and a shower nozzle 75. The warm water is directed onto the patient by directing the flow of water from the shower nozzle 75. The water drains from the patient into the reservoir 70 and through a drain port 76 and drain hose 77 into a collection bag or bucket 78 for disposal.

The bag 73 is a conventional portable shower bag which can be purchased at camping supply stores, and holds approximately five gallons of water.

The reservoir 70 may be somewhat deeper at the head or foot end as desired, in order to facilitate drainage of the water to the drain port 76.

If a shower bath is not given, the patient can be bathed with a wash cloth, with any rinse water collecting in the reservoir 70 for disposal as described above. When the bath is completed, the reservoir 70 can then be carried to the next bed for use in bathing the next patient.

DESCRIPTION OF APPARATUS FIG. 17

Figure 17:
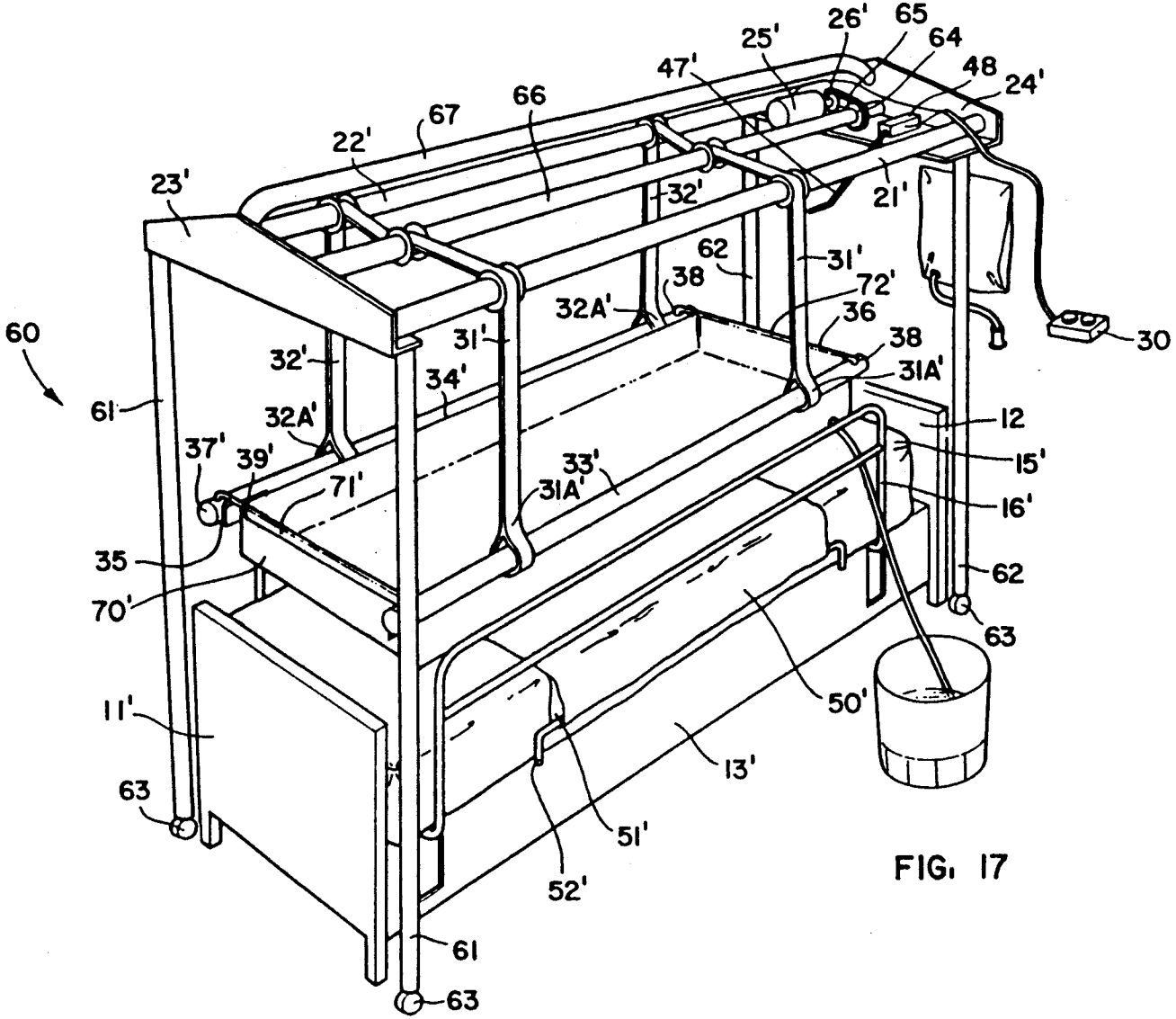
FIG. 17 is a perspective view of an apparatus for lifting and turning an invalid patient positioned on a hospital bed, which bed includes a portable reservoir for catching bathing water according to a further embodiment of the invention.

A similar arrangement is shown in connection with a modified type of apparatus 60 in FIG. 17.

In the apparatus 60 the reservoir 70' can be connected to the braces 35', 36', by the end curved end flange 71', 72' so that the apparatus 60 can then be rolled from patient to patient with the reservoir 70' suspended on the braces 35', 36'. After the apparatus 60 is rolled into position over a bed, the reservoir 70 is removed from the braces 35', 36' and placed directly on the mattress 50. The patient is suspended over the reservoir 70 as is best shown in FIG. 16.

In all of the embodiments disclosed above, the ability to interchange the straps 40–44 while the straps support the patient is very important to the operation of the bed. In the preferred embodiment, the lambs wool provides a soft cushion support which, it has been found, prevents the formation of pressure or bed sores on bedridden patients.

An apparatus for lifting and bathing a patient is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An invalid patient lifting, turning and bathing apparatus, comprising:

(a) an open framework for being positioned above a bed;

(b) elevator means supported by said open framework, said elevator means including a motor and a winding bar mounted on said framework and extending along the length of the framework for being rotationally driven by said motor;

(c) winding strap means connected to said winding bar and to first and second spacing bars positioned on opposite sides of the framework;

(d) said strap means extending around said winding bar in a clockwise direction and in a counterclockwise direction whereby rotation of said motor in one direction winds said strap means onto said winding bar and rotation in the other direction unwinds said strap means off of said winding bar and thereby lowers or raises said spacing bars;

(e) patient support means for being positioned on a mattress of the bed underneath the patient and remaining underneath the patient at all times, said support means comprising a plurality of spaced-apart, removable and replaceable support strap means secured by opposite ends to said spacing bars and extending laterally from side-to-side along the length of the patient for supporting the patient's head, trunk and legs thereby permitting the strap means to lift the patient above the mattress surface for cleaning and bed-linen changing;

(f) patient turning means for being connected to said elevator means for turning the patient from side-to-side in the bed, said patient turning means including sheet attachment means for being attached to a draw sheet extending under the patient and for being pulled diagonally laterally across the bed from one side towards the opposite side of the bed by said winding strap means; and (g) patient bathing reservoir means for being positioned under the patient while the patient is lifted above the mattress surface by the patient support means.

2. A lifting and turning apparatus according to claim 1, wherein said elevator means comprises:

(a) first and second spaced-apart winding bars extending along the length of the framework;

(b) a motor carried by said framework; and (c) drive means operatively interconnecting said motor and said first and second winding bars for rotating said winding bars in opposite winding and unwinding directions.

3. A lifting and turning apparatus according to claim 2, wherein said drive means comprises:

(a) a drive sprocket on said motor;

(b) first and second driven sprockets positioned for rotation respectively with said first and second winding bars; and (c) an endless chain interconnecting said drive sprocket and said first and second driven sprockets for transmitting rotary motion from said motor to said first and second winding bars.

4. A lifting and turning apparatus according to claim 2, wherein said drive means comprises:

(a) a third winding bar mounted on said framework between said first and second winding bars and extending along the length of the framework in axial alignment with said first and second winding bars;

(c) first and second straps, each connected by one end thereof to said third winding bar and by the opposite end thereof to respective ones of the first and second winding bars;

(d) one of said first and second straps extending around said third winding bar in a clockwise direction and the other of said first and second straps extending around said third winding bar in a counterclockwise direction whereby rotation of said motor in one direction winds both first and second straps onto said third winding bar and rotation in the other direction unwinds both the first and second straps off of said third winding bar.

5. An invalid patient lifting, and bathing apparatus, comprising:

(a) a framework for being positioned above a bed;

(b) elevator means supported by said framework, said elevator means including a pair of spaced-apart stationary winding bars, a motor and a rotatable winding bar mounted generally centrally on said framework between said stationary winding bars, and extending along the length of the framework for being rotationally driven by said motor;

(c) winding strap means connected to said rotatable winding bar and to first and second spacing bars positioned on opposite sides of the framework, said strap means passing over said stationary winding bars;

(d) said winding strap means extending around said rotatable winding bar in a clockwise direction and in a counterclockwise direction whereby rotation of said motor in one direction winds said strap means onto said rotatable winding bar and rotation in the other direction unwinds said strap means off of said rotatable winding bar and thereby lowers or raises said spacing bars;

(e) patient support means for being positioned on a mattress of the bed underneath the patient and attached to said spacing bars for lifting the patient above the mattress surface for cleaning, bathing and bed-linen changing; and (f) patient bathing reservoir means for being positioned under the patient while the patient is lifted above the mattress surface by the patient support means and for trapping bathing water which is directed onto the patient.

6. A lifting and turning apparatus according to claims 1 or 5, wherein said patient bathing reservoir means comprises:

(a) a shallow plastic reservoir for being positioned on the mattress under the patient; and (b) portable water supply means for supplying a supply of water to the apparatus.

7. A lifting and turning apparatus according to claim 6, wherein said reservoir includes drain means therein for allowing water in the reservoir to flow by gravity out of the reservoir.

8. A lifting and turning apparatus according to claim 7, wherein said drain means includes a water collection bag or bucket.

9. A lifting and turning apparatus according to claims 1 or 5, wherein said patient support means comprises soft, resilient straps having releasing means for releasing said straps from said spacing bars, and for reattaching said straps to said spacing bars.

10. A lifting and turning apparatus according to claims 1 or 5, wherein said patient support means comprises first and second sets of soft-resilient straps having releasing means for releasing soiled ones of said straps from said spacing bars, and for reattaching clean straps to said spacing bars.

11. A lifting and turning apparatus according to claims 1 or 5, wherein said patient support means comprises soft, resilient straps having releasing means for releasing soiled ones of said straps from said spacing bars, and for reattaching said straps to said spacing bars after laundering.

12. A lifting and turning apparatus according to claims 1 or 5, wherein said bathing apparatus includes shower means for giving the patient a shower while being supported in a spaced-apart position above the reservoir.

13. A lifting and turning apparatus according to claim 12, wherein said shower means comprises a water bag for being suspended above the apparatus at a height above the patient and a shower nozzle fluidly communicating with the water bag to enable water in the bag to be directed onto the patient.

* * * * *